US008068755B2

(12) United States Patent
Kojima

(10) Patent No.: US 8,068,755 B2
(45) Date of Patent: Nov. 29, 2011

(54) IMAGE FORMING APPARATUS

(75) Inventor: Etsuji Kojima, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 515 days.

(21) Appl. No.: 12/234,548

(22) Filed: Sep. 19, 2008

(65) Prior Publication Data

US 2009/0080924 A1 Mar. 26, 2009

(30) Foreign Application Priority Data

Sep. 20, 2007 (JP) ..... 2007-243959

(51) Int. Cl.
*G03G 15/16* (2006.01)
*G03G 15/01* (2006.01)

(52) U.S. Cl. ..... 399/66; 399/302; 399/303

(58) Field of Classification Search ..... 399/66, 399/302, 303
See application file for complete search history.

(56) References Cited

U.S. PATENT DOCUMENTS

| | | | | |
|---|---|---|---|---|
| 5,646,717 | A | 7/1997 | Hiroshima et al. | |
| 5,907,758 | A | 5/1999 | Tanaka et al. | |
| 6,021,287 | A | 2/2000 | Tanaka | |
| 6,324,359 | B1 * | 11/2001 | Nakane | 399/66 |
| 6,804,481 | B2 | 10/2004 | Mochizuki et al. | |
| 6,842,600 | B2 | 1/2005 | Takayanagi | |
| 6,904,245 | B2 | 6/2005 | Mochizuki et al. | |
| 7,062,208 | B2 | 6/2006 | Takayanagi | |
| 2003/0156863 | A1 | 8/2003 | Takayanagi | |
| 2003/0215251 | A1 | 11/2003 | Mochizuki et al. | |
| 2004/0062560 | A1 | 4/2004 | Mochizuki et al. | |
| 2005/0095042 | A1 | 5/2005 | Takayanagi | |
| 2007/0047986 | A1 * | 3/2007 | Fujimori et al. | 399/49 |

FOREIGN PATENT DOCUMENTS

| | | | |
|---|---|---|---|
| CN | 1452025 | A | 10/2003 |
| CN | 1497374 | A | 5/2004 |
| EP | 853259 | A3 | 7/1998 |
| EP | 1355203 | A3 | 4/2003 |
| JP | 05-006112 | A | 1/1993 |
| JP | 11-202651 | A | 7/1999 |
| JP | 2002-056587 | A | 2/2002 |
| JP | 2002-196596 | A | 7/2002 |
| JP | 2003-005466 | A | 1/2003 |
| JP | 2007-079071 | A | 3/2007 |

* cited by examiner

*Primary Examiner* — David Gray
*Assistant Examiner* — Joseph S Wong

(57) ABSTRACT

An image forming apparatus is provided in which image forming sections are provided along an intermediate transfer member and in which a test voltage is applied to a transfer member to control a transfer voltage. In the image forming apparatus, the test voltage is applied to a region of the intermediate transfer member in an upstream image forming section. The test voltage is controlled so as to be applied at a time except when that region of the intermediate transfer member passes through a downstream image forming section. Accordingly, when the intermediate transfer member is charged by applying the test voltage to the transfer member in the upstream image forming section, the transfer voltage can be appropriately controlled in the downstream image forming section.

17 Claims, 12 Drawing Sheets

IMAGE FORMING APPARATUS

BACKGROUND OF THE INVENTION

1. Field of the Invention

The present invention relates to an image forming apparatus for transferring toner images from image bearing members to an intermediate transfer member or to a recording medium carried by a belt member, and, more specifically, to a control operation for controlling a transfer voltage that is to be applied to transfer members when the toner images are transferred.

2. Description of the Related Art

There is an image forming apparatus for forming an image on a recording medium using image forming sections provided along an intermediate transfer member (see Japanese Patent Laid-Open No. 2002-0056587). In the image forming apparatus, in the corresponding image forming sections, toner images formed on photoconductor drums are transferred onto the intermediate transfer member at primary transfer portions by primary transfer members to which a primary transfer voltage is applied. The toner images which are primarily transferred from the image forming sections are simultaneously secondarily transferred onto a recording medium.

In contrast, Japanese Patent Laid-Open No. 05-006112 discloses a method for controlling a transfer voltage using so-called active transfer voltage control (ATVC), in which different test voltages are applied to a transfer roller to obtain a voltage-versus-current relationship, and in which a transfer voltage that causes a desired current to flow is set in accordance with the voltage-versus-current relationship.

When the control method using the ATVC is applied to the above-mentioned apparatus, a configuration is provided, in which ATVC operations are simultaneously performed on upstream and downstream image forming sections that are provided in a moving direction of an intermediate transfer belt (see Japanese Patent Laid-Open No. 11-202651). In this configuration, it is difficult to obtain the voltage-versus-current relationship resulting from stable measurement when the test voltages are applied. As a result, it is difficult to set an appropriate primary transfer voltage.

In other words, when an ATVC operation is performed, the intermediate transfer member is charged. Additionally, currents that flow when the test voltages are applied are changed in accordance with a charge state of the intermediate transfer member. When measurement of a current is performed in a downstream image forming section that is provided in a moving direction of the intermediate transfer member, it is difficult to stably measure the current because the intermediate transfer member is charged by an ATVC operation that has been performed on an upstream image forming section.

FIG. 10 illustrates a voltage-versus-current relationship obtained in a case in which one of the test voltages is applied simultaneously to all of the image forming sections. In contrast, FIG. 11 illustrates a voltage-versus-current relationship obtained in a case in which the test voltage is applied to the image forming sections at different times. Note from FIGS. 10 and 11 that the voltage-versus-current relationship obtained in a case in which the test voltage is applied simultaneously to all of the image forming sections differs from the voltage-versus-current relationship obtained in a case in which the test voltage is applied to the image forming sections at different times.

The difference between the relationships is caused by an influence of the test voltage that has been applied in an upstream image forming section. Regarding a transfer portion of the most upstream image forming section, there is no difference between the voltage-versus-current relationship shown in FIG. 10 and the voltage-versus-current relationship shown in FIG. 11. The reason for this is that the intermediate transfer member has not been charged when a current is measured in the most upstream image forming section. In contrast, when currents are measured in second to fourth image forming sections, the intermediate transfer member has already been charged by an ATVC operation performed on the most upstream image forming section. Accordingly, errors occur.

Next, an influence that charging of an intermediate transfer member has on control of a primary transfer voltage is described. FIG. 12 is a schematic diagram of a current path of a primary transfer portion. The current path can be considered to extend from a power source (not shown) connected to a primary transfer roller 5 to electrical ground. As shown in FIG. 12, the current path is divided into two paths.

The two paths are as follows: a path (1) is a path from the primary transfer roller 5 via the intermediate transfer member 7 to a photoconductor drum 1; and a path (2) is a path through which a current flows due to an influence of a capacitance of the intermediate transfer member 7. A current that is necessary for transfer of a toner image is a current that flows through the path (1). In contrast, the current that flows through the path (2) is mainly used to charge the intermediate transfer member, and it contributes little to transfer of a toner image. For this reason, in order to set an appropriate primary transfer voltage, it is necessary to accurately measure the current that flows through the path (1).

The current that flows through the path (2) can be estimated in a state in which the intermediate transfer member is not charged. Accordingly, a voltage-versus-current relationship is obtained by measuring the amounts of currents in a state in which the intermediate transfer member is not charged. Then, the amount of current that is obtained by adding the amount of current which flows through the path (2) to the amount of current according to the voltage-versus-current relationship, i.e., the amount of current that is obtained by adding the "amount of current which flows through the path (2)" to the "amount of current which flows though the path (1)", is determined as the value of a target current. A voltage that causes the target current to flow is set as a primary transfer voltage. The primary transfer voltage is set in this manner, whereby the current that flows through the path (1) when primary transfer is performed can be easily adjusted to a desired current.

However, when the primary transfer voltage is to be set in accordance with a voltage-versus-current relationship obtained in a state in which the intermediate transfer member is charged, it is necessary to estimate the amount of charge on the intermediate transfer member.

In reality, there are a large number of related parameters, such as parameters related to a charge state of the intermediate transfer member in an upstream image forming section, and parameters related to an attenuation state after the intermediate transfer member passes through the upstream image forming section. Thus, it is difficult to estimate the amount of current that flows through the path (2).

SUMMARY OF THE INVENTION

It is desirable to provide an image forming apparatus that can increase detection accuracy of the amount of current which flows thorough a transfer member.

According to an aspect of the present invention, there is provided an image forming apparatus including the following elements: a belt member; a first image bearing member; a first transfer member configured to form a first transfer portion that transfers a toner image formed on the first image bearing member onto the belt member; a second image bearing member that is disposed at a certain position so that the first and second image bearing members are adjacent to each other; a second transfer member configured to form a second transfer portion that transfers a toner image formed on the second image bearing member onto the belt member; an execution unit configured to execute a first step of determining a value of a voltage to be applied to the first transfer member, the voltage being used to transfer the toner image onto the belt member by applying the voltage to the first transfer member, and a second step of determining a value of a voltage to be applied to the second transfer member, the voltage being used to transfer the toner image onto the belt member by applying the voltage to the second transfer member; and a control unit configured to control execution timing of the first and second steps so that a region of the belt member corresponding to the first transfer member to which the voltage is applied in the first step does not overlap a region of the belt member corresponding to the second transfer member to which the voltage is applied in the second step.

Further features of the present invention will become apparent from the following description of exemplary embodiments with reference to the attached drawings.

DESCRIPTION OF THE EMBODIMENTS

First Embodiment

An image forming apparatus according to a first embodiment of the present invention is described below in detail with reference to the accompanying drawings. Known items associated with configurations and control operations of image forming apparatuses, such as those disclosed in Japanese Patent Laid-Open Nos. 2002-0056587, 05-006112, and 11-202651, are briefly discussed where useful to understanding the present invention.

Overall Configuration of Image Forming Apparatus

Figure 1:
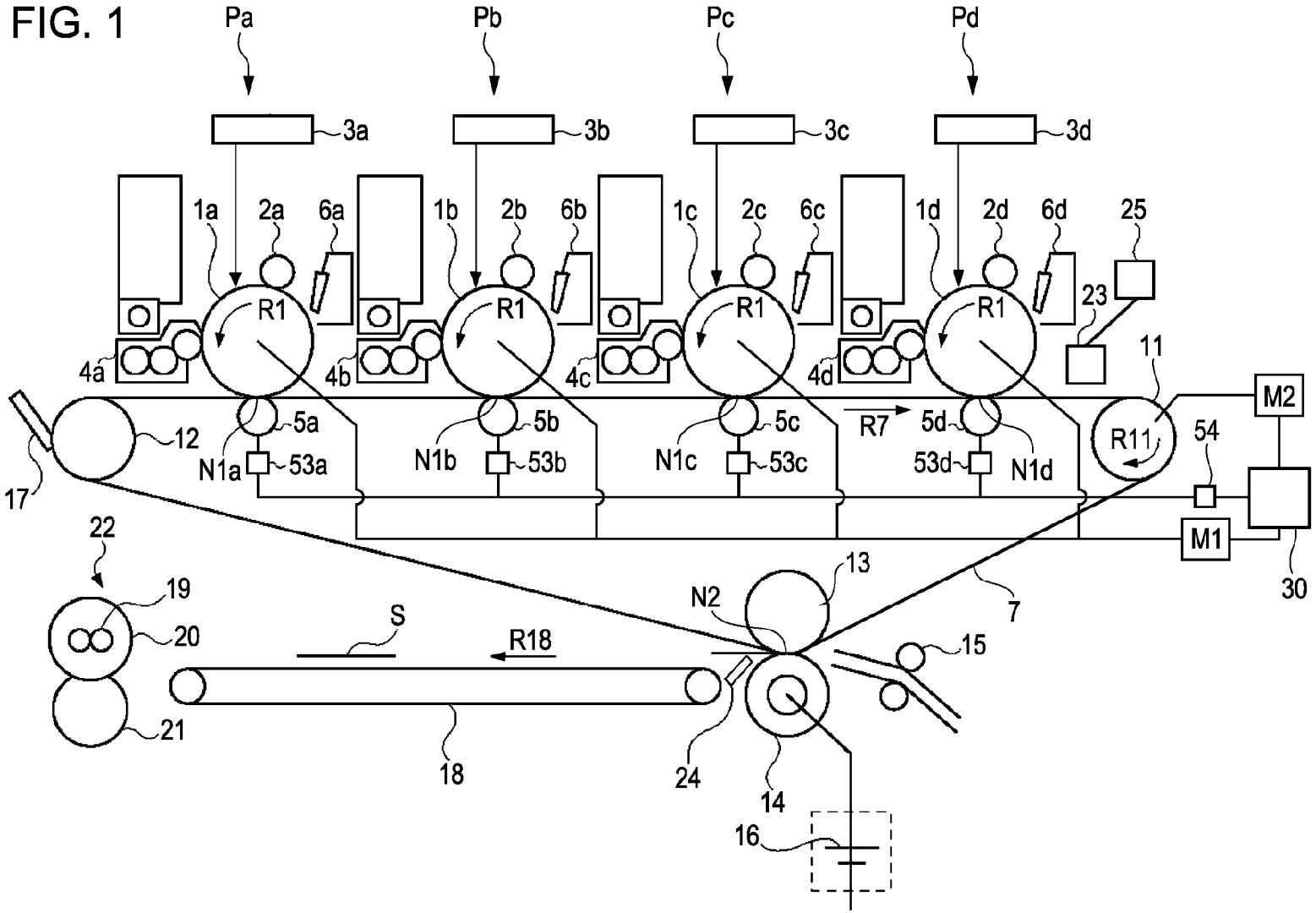
FIG. 1 is a sectional view of a configuration of an image forming apparatus according to a first embodiment of the present invention.

FIG. 1 is a schematic sectional view of the image forming apparatus according to the first embodiment. An image forming apparatus 100 according to the first embodiment is a full-color image forming apparatus using image forming sections and an intermediate transfer belt.

As shown in FIG. 1, four image forming sections Pa, Pb, Pc, and Pd for magenta, cyan, yellow, and black, respectively, are disposed along a moving direction of an intermediate transfer belt (an intermediate transfer member) 7. The image forming sections Pa, Pb, Pc, and Pd, form magenta, cyan, yellow, and black toner images, respectively. The image forming sections have the same configuration except that colors of toners that are used in development devices 4*a*, 4*b*, 4*c*, and 4*d* are different from one another. Accordingly, in FIG. 2, subscripts a, b, c, and d for distinguishing the four image forming sections from one another are omitted, and an overall configuration and an overall operation are described.

Figure 2:
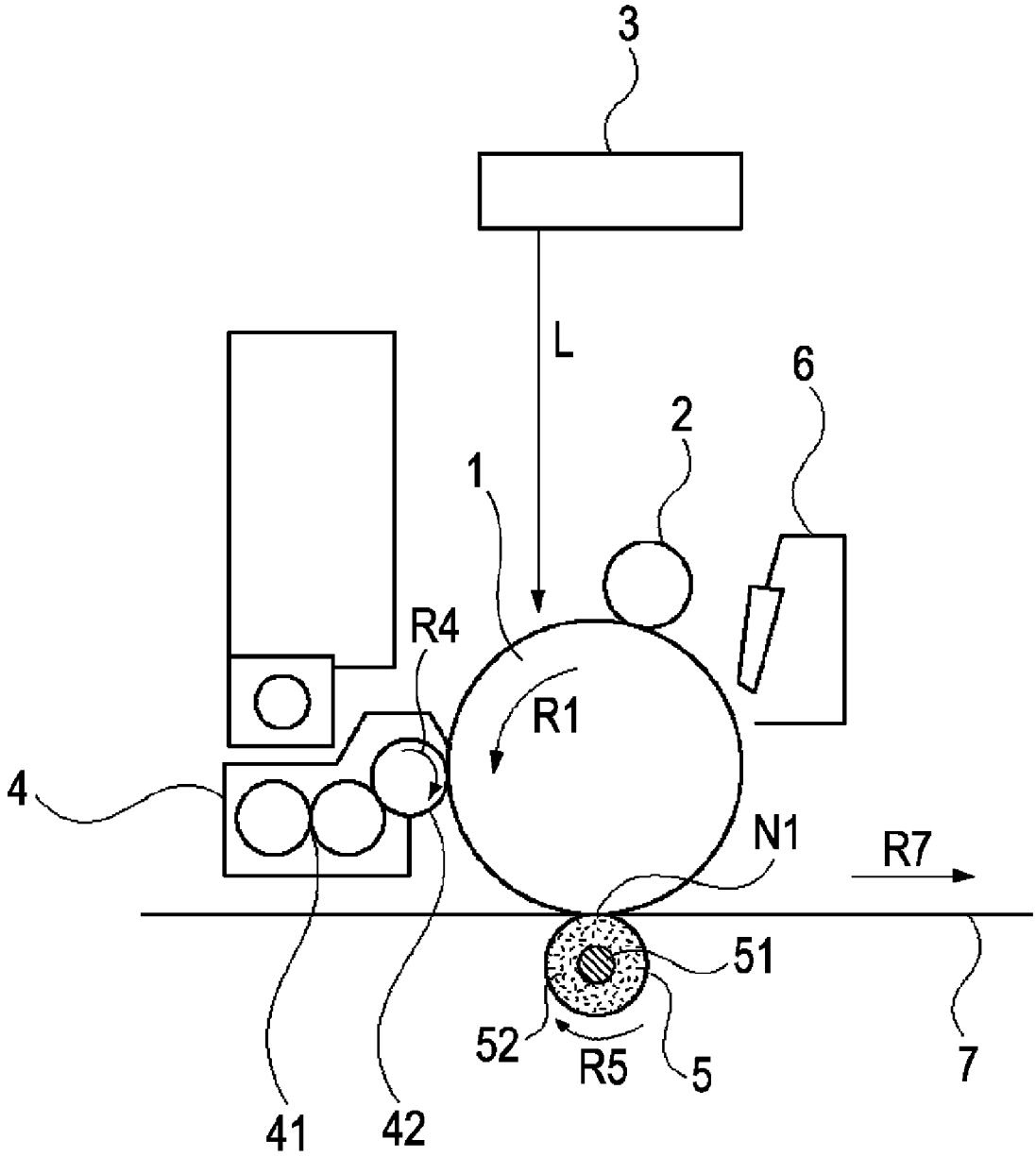
FIG. 2 is a view of a configuration of an image forming section.

FIG. 2 is a diagram of an image forming section P. A photoconductor drum 1 (image bearing member) that is provided in the image forming section P is rotatably driven by a driving unit M1 at a process speed (a circumferential speed) of 100 mm/sec. in the direction indicated by an arrow R1. A charging roller (a charging unit) 2, an exposure device (an electrostatic-image forming unit) 3, a development device (a development unit) 4, a primary transfer roller (transfer member) 5, and a cleaning device 6 are disposed in approximately this order along a rotation direction of the photoconductor drum 1 in the periphery of the photoconductor drum 1.

When the photoconductor drum 1 is rotatably driven, the surface of the photoconductor drum 1 is charged by the charging roller 2. The charging roller 2 is in contact with the surface of the photoconductor drum 1. A charge bias is applied to the charging roller 2 by a power supply 54 (FIG. 1), whereby the surface of the photoconductor drum 1 is uniformly charged to have a potential of −600 V.

An electrostatic image is formed by the exposure device 3 on the charged surface of the photoconductor drum 1. The exposure device 3 emits laser light L in accordance with image information, and it 3 exposes the surface of the photoconductor drum 1 to the laser light L. Charge is removed from an exposed portion of the charged surface of the photoconductor drum 1, resulting in formation of an electrostatic image.

When the electrostatic image reaches the development device 4, the electrostatic image is developed by the development device 4. The development device 4 includes a developer container 41 that contains a two-element developer in which non-magnetic toner particles (toner) and magnetic carriers (carriers) are mixed. The developer is agitated in the developer container 41, and the non-magnetic toner particles are negatively charged.

The developer is carried by a development sleeve 42 that is rotated in the direction indicated by an arrow R4. When a negative development bias is applied to the development sleeve 42 by the power supply 54, the non-magnetic toner particles in the developer that is carried by the surface of the development sleeve 42 are adhered to the exposed portion of the electrostatic image, resulting in development of the electrostatic image as a toner image.

Next, the toner image formed on the photoconductor drum (the first image bearing member and the second image bearing member) 1 is primarily transferred onto the intermediate transfer belt (the intermediate transfer member) 7, which is a belt member, by the primary transfer roller (the first and second transfer members) 5 to which a positive primary transfer voltage is applied. In other words, a toner image formed on a photoconductor drum 1 of the image forming section Pc serving as a first image forming section is primarily transferred onto the intermediate transfer belt 7. Similarly, a toner image formed on a photoconductor drum 1 of the image forming section Pd serving as a second image forming section is primarily transferred onto the intermediate transfer belt 7. The primary transfer roller 5 has a configuration in which a cylindrical conductive layer 52 is disposed on the outer peripheral surface of a metallic shaft 51. The diameter of the primary transfer roller 5 is 16 mm. In a case in which the primary transfer roller 5 is placed on a metallic board, when a voltage of 50 V is applied between the board and the shaft 51 and then the resistance of the primary transfer roller 5 is measured, the resistance is $1\times10^{7}\Omega$.

Additionally, in the first embodiment, the resistances of the primary transfer rollers 5 are substantially equal to one another in the four image forming sections Pa, Pb, Pc, and Pd. The resistances of the primary transfer rollers 5 are not limited to $1\times10^{7}\Omega$. Any resistance in the range of $1\times10^{5}$ to $9\times10^{7}\Omega$ can be used as each of the resistances of the primary transfer rollers 5. The primary transfer roller 5 presses the intermediate transfer belt 7 from the back side of the intermediate transfer belt 7 so that the front side of the intermediate transfer belt 7 can be in contact with the surface of the photoconductor drum 1. Accordingly, a primary-transfer nip portion N1 that is a transfer portion is formed between the surface of the photoconductor drum 1 and the intermediate transfer belt 7. The intermediate transfer belt 7 is rotatably driven in the direction indicated by an arrow R7, and the primary transfer roller 5 is rotated by the rotation of the intermediate transfer belt 7 in the direction indicated by an arrow R5. The primary transfer voltage is controlled by the power supply 54 as a constant voltage. The primary transfer voltage is applied from the power supply 54 to the primary transfer roller 5 to cause the above-described toner image formed on the surface of the photoconductor drum 1 to be electrostatically primarily transferred onto the surface of the intermediate transfer belt 7 at the primary-transfer nip portion N1.

Toner (remaining toner) that remains on the surface of the photoconductor drum 1 without being transferred onto the intermediate transfer belt 7 when primary transfer is performed is removed by a cleaning blade of the cleaning device 6. The photoconductor drum 1 whose surface has been cleaned in this manner is ready for the next image forming operation that is to start from the charging operation.

In the first embodiment, the photoconductor drum 1, the charging roller 2, the development device 4, and the cleaning device 6 are integrally incorporated into a cartridge (a process cartridge) as a whole. The cartridge is arranged to be detachably attached to the main body (not illustrated) of the image forming apparatus. For example, when the photoconductor drum 1 reaches the end of its life, the entire cartridge is removed from the main body of the image forming apparatus to be replaced with a new one.

Magenta, cyan, yellow, and black toner images are each formed on a photoconductor drum 1 of a corresponding one of the image forming sections Pa, Pb, Pc, and Pd. When the primary transfer voltage is applied to primary transfer rollers 5 of the corresponding image forming sections, the toner images are primarily transferred onto the intermediate transfer belt 7 in such a manner that the toner images are sequentially superimposed on top of one another. The image forming sections Pa, Pb, Pc, and Pd are provided at intervals of 70 mm.

The intermediate transfer belt 7 is endless and is stretched around three rollers, namely, a driving roller 11, a driven roller 12, and a secondary-transfer counter roller 13. The driving roller 11 is rotated by a driving unit M2 in the direction indicated by an arrow R11 (in a clockwise direction indicated in FIG. 1), and the intermediate transfer belt 7 is rotated by the rotation of the driving roller 11 in the direction indicated by the arrow R7. The intermediate transfer belt 7 is formed of a dielectric resin such as polyimide, polycarbonate, polyethylene terephthalate, or polyvinylidene fluoride so as to be endless. In the first embodiment, a polyimide resin is adjusted so as to have a volume resistivity of $1\times10^{9}\Omega\cdot$cm and is shaped as an endless belt having a thickness of 50 μm. The endless belt is used as the intermediate transfer belt 7. Additionally, the surface resistivity of the intermediate transfer belt 7 is $1\times10^{12}$ Ω/sq. The surface resistivity of the intermediate transfer belt 7 is not limited to this value. Any value in the range of $1\times10^{11}$ to $9\times10^{13}$ Ω/sq. can be used as the surface resistivity of the intermediate transfer belt 7. The surface resistivity of the intermediate transfer belt 7 is a value that is measured when a voltage of 100 V is applied to a JIS probe.

A secondary transfer roller (a secondary transfer unit) 14 is in contact with the outer peripheral surface of the intermediate transfer belt 7 at a position corresponding to the secondary-transfer counter roller 13. A secondary-transfer nip portion (a secondary transfer portion) N2 is formed between the secondary transfer roller 14 and the intermediate transfer belt 7. The secondary-transfer counter roller 13 is a metallic roller, and it 13 is electrically grounded. In contrast, the secondary transfer roller 14 has a configuration in which a cylindrical conductive layer is disposed on the outer peripheral surface of a metallic shaft. The diameter of the secondary transfer roller 14 is 20 mm.

The toner images having the four colors, which have been primarily transferred in the corresponding image forming sections to be superimposed on top of one another on the intermediate transfer belt 7, are transferred onto a recording medium S by the secondary transfer roller 14. The intermediate transfer belt 7 is sandwiched between the secondary transfer roller 14 and the secondary-transfer counter roller 13. Accordingly, the secondary-transfer nip portion N2 is formed between the secondary transfer roller 14 and the intermediate transfer belt 7.

The recording medium S, which is supplied for an image forming operation, is stored in a sheet feeding cassette (not illustrated). The recording medium S stored in the sheet feeding cassette is conveyed to registration rollers 15 by a feeding and conveying device including a sheet feeding roller, a conveying roller, a conveying guide, and so forth which are not illustrated. After the recording medium S is corrected for skew between the registration rollers 15, the recording medium S is supplied to the secondary-transfer nip portion N2.

When the recording medium S passes through the secondary-transfer nip portion N2, a positive secondary transfer bias is applied from a secondary-transfer-bias-applying power supply 16 to the secondary transfer roller 14, whereby the toner images having the four colors on the intermediate transfer belt 7 are simultaneously secondarily transferred onto the recording medium S. In this case, toner (remaining toner) that remains on the intermediate transfer belt 7 without being transferred onto the recording medium S is removed by a belt cleaner 17 that is disposed at a position corresponding to the driven roller 12.

Charge on the recording medium S onto which the toner images have been secondarily transferred is removed by a discharging needle 24 that is electrically grounded. Then, the recording medium S is conveyed to a fixing device 22 by a conveying belt 18 that is rotated in the direction indicated by an arrow R18. The fixing device 22 includes a fixing roller 20 in which heaters 19 are disposed. The fixing device 22 also includes a pressure roller 21 that forms a fixing nip portion between the pressure roller 21 and the fixing roller 20 which is pressed by the heaters 19. When the recording medium S passes through the fixing nip portion, the recording medium S is heated and pressed by the fixing roller 20 and the pressure roller 21, whereby the toner images are fixed onto the surface of the recording medium S. The recording medium S onto which the toner images have been fixed is ejected to outside the body (not illustrated) of the image forming apparatus. In this manner, an image forming operation for forming a four-color full-color image on a sheet of the recording medium S is finished.

In the first embodiment, a density sensor 23 is provided so as to face the surface of a portion of the intermediate transfer belt 7 stretched around the driving roller 11. The density sensor 23 includes a reflective sensor having a light emitting device (LED) and a photo detector. Toner images (hereinafter, referred to as "detection toner images"), each of which is used as a reference of the density of a corresponding color in a corresponding one of the image forming sections Pa, Pb, Pc, and Pd, are formed on the intermediate transfer belt 7. The density sensor 23 detects the amounts of light reflected by the detection toner images to obtain detection results. The detection results are sent to a density control unit 25. The density control unit 25 calculates the amounts of toners that are carried by the intermediate transfer belt 7 on the basis of the amounts of reflected light that are detected by the density sensor 23 to obtain a calculation result. Then, the density control unit 25 controls a ratio of the amount of magnetic carriers to the amount of non-magnetic carriers that are stored in the developer container 41, an electric potential at which the photoconductor drum 1 is to be charged by the charging roller 2, or the like on the basis of the calculation result.

Primary Transfer Voltage Control

Next, a method for setting a primary transfer voltage in the first embodiment will be described. It is difficult to suppress a variation in the resistance of the primary transfer roller 5 that occurs from one roller to another when the rollers are manufactured. In addition, the resistance of the primary transfer roller 5 changes as the roller ages. For this reason, by using a control or test operation, i.e., an ATVC operation, the primary transfer voltage is adjusted in accordance with a change in resistance. In the ATVC operation, first, when a normal image forming operation is not performed, different voltages for test (test voltages or test energizations) are applied to the primary transfer roller 5 in a state in which the photoconductor drum 1 is charged, and currents that pass through the primary transfer roller 5 are detected to obtain a voltage-versus-current relationship. Then, a voltage that causes a predetermined current (a target current) to pass through the primary transfer roller 5 is calculated in accordance with the voltage-versus-current relationship, and is determined as a primary transfer voltage. When an image forming operation is performed, the primary transfer voltage that is determined in this manner is controlled as a constant voltage, and is applied to the primary transfer roller 5. The ATVC operation is performed when a power supply of the body of the image forming apparatus is turned on, when pre-image-formation rotation is performed before an image is formed, when post-image-formation rotation is performed, or every time a predetermined number of sheets (for example, 500 sheets) are printed out.

Figure 4:
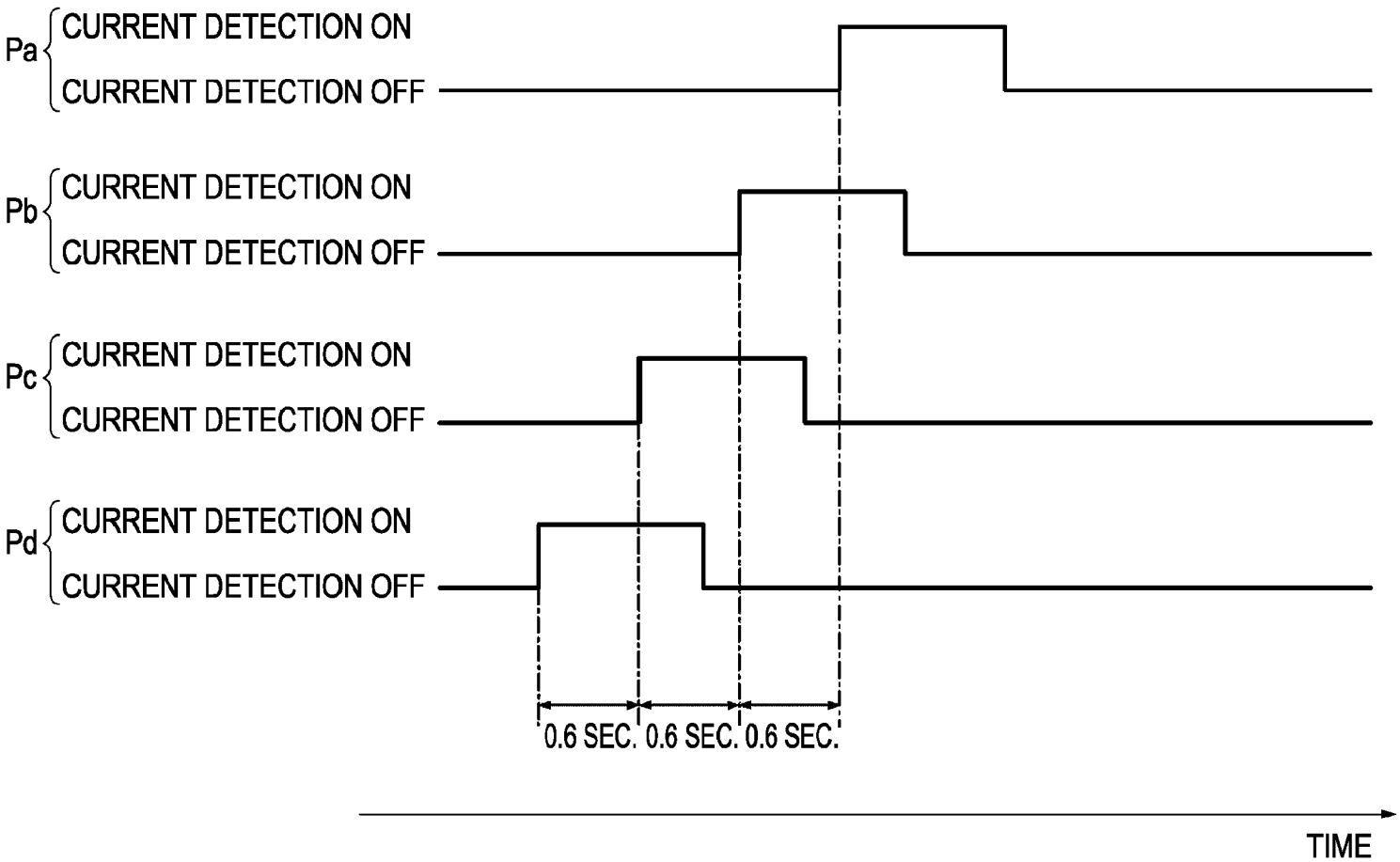
FIG. 4 is a timing chart of ATVC operations according to the first embodiment.

FIG. 4 is a timing chart showing the sequence of ATVC operations according to the first embodiment. Referring to FIG. 4, periods are shown, in each of which a current detecting operation for detecting a current that passes through the primary transfer roller 5 is performed. As shown in FIG. 4, first, a current detecting operation is started to be performed on the image forming section Pd, which is the most downstream image forming section in the rotation direction of the intermediate transfer belt 7, and then current detecting operations are sequentially started to be performed on the image forming sections Pc, Pb, and Pa.

Figure 3:
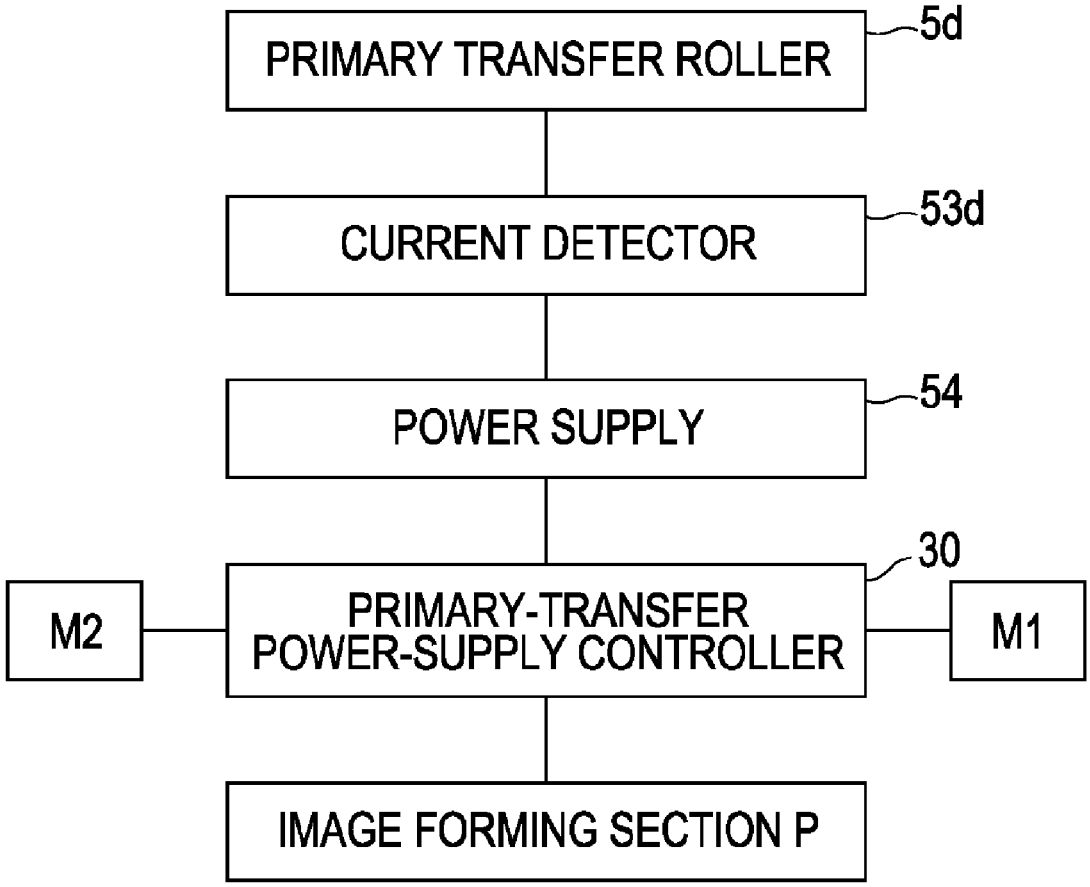
FIG. 3 is a block diagram showing units associated with an ATVC operation according to the first embodiment.

First, a current detecting operation is started to be performed on the image forming section Pd, which is the most downstream image forming section P in the moving direction of the intermediate transfer belt 7 and on which primary transfer is performed last when an image forming operation is performed. A primary-transfer power-supply controller 30 is a controller (a central processing unit (CPU)), and functions as an execution unit that executes processes of ATVC operations, and as a controller that controls timing at which ATVC operations are performed on the corresponding image forming sections. FIG. 3 is a block diagram showing units associated with an ATVC operation. The primary-transfer power-supply controller 30 controls operations for driving the driving units M1 and M2, and controls ATVC operations. In an ATVC operation according to the first embodiment, the primary-transfer power-supply controller 30 controls the power supply 54 in a state in which a photoconductor drum 1*d* is charged to have a potential of −600 V so that three test voltages, namely, Vft1, Vft2, and Vft3, can be sequentially applied to a primary transfer roller 5*d*. Any value can be set as each of the test voltages for each of the image forming sections Pa, Pb, Pc, and Pd. However, in the first embodiment, the same voltage is used for all of the image forming sections P. The test voltage Vft1 is +200 V, the test voltage Vft2 is +400 V, and the test voltage Vft3 is +600 V.

Each of the test voltages is applied to the primary transfer roller 5*d* while the primary transfer roller 5*d* is rotated at least once. The reason for this is that the resistance of the primary transfer roller 5*d* may fluctuate along the circumferential direction of the primary transfer roller 5*d*. While each of the test voltages is being applied, the current detection unit 53*d* measures the amount of current that passes through the primary transfer roller 5*d*.

A current detection period T from when an application of the first test voltage Vft1 is started to when an application of the third test voltage Vft3 is finished is determined on the basis of a diameter (16 mm) of the primary transfer roller 5*d* and the moving velocity (140 mm/sec.) of the intermediate transfer belt 7. In other words, the current detection period T is set to 1.0 sec. in accordance with the equation $(16\times3.14/140)\times3=1.0$.

Figure 5:
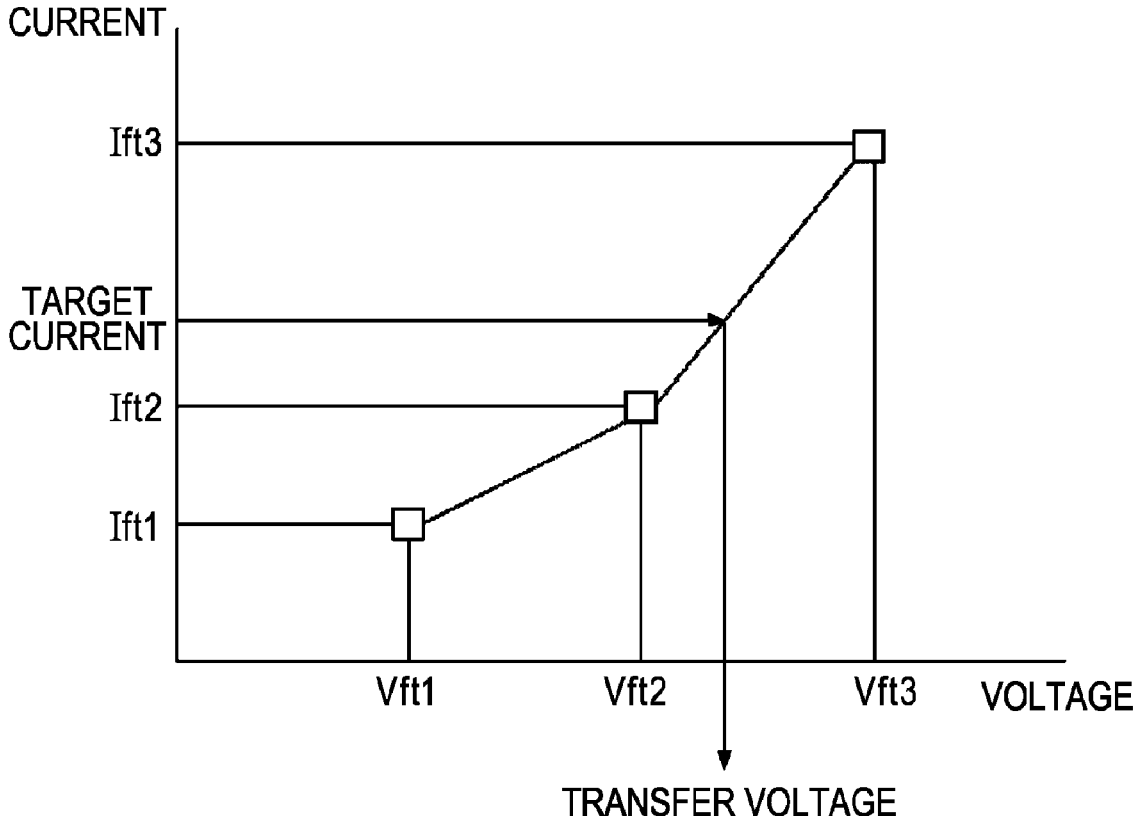
FIG. 5 is a graph showing a voltage-versus-current relationship and the value of a target current.

The primary-transfer power-supply controller 30 determines a voltage-versus-current relationship shown in FIG. 5 on the basis of currents (detection results) Ift1, Ift2, and Ift3 that passed through the primary transfer roller 5*d* when the test voltages Vft1, Vft2, and Vft3 were applied. In the first embodiment, for example, the current Ift1 was 5 μA, the current Ift2 was 10 μA, and the current Ift3 was 15 μA.

Then, in accordance with the voltage-versus-current relationship, a voltage corresponding to a target current is set as the primary transfer voltage. A target current used in the ATVC operation performed on the image forming section Pd is 10 μA. Additionally, target currents used in ATVC operations performed later on the image forming sections Pc, Pb, and Pa are also 10 μA. It is therefore determined that the required primary transfer voltage for the image forming section Pd is +400 V. When the target current is not equal to any of the measured currents Ift1, Ift2 and Ift3, in accordance with the voltage-versus-current relationship shown in FIG. 5, the required primary target voltage can be derived by interpolation (as shown in FIG. 5 itself) or by extrapolation from the measurement results.

Next, as in the case of the image forming section Pd, an ATVC operation is performed on the yellow image forming section Pc, which is disposed adjacent to the black image forming section Pd and which is provided on the upstream side in the moving direction of the intermediate transfer belt 7. A time at which the first test voltage Vft1 is started to be applied to a primary transfer roller 5*c* of the yellow image forming section Pc is 0.6 sec. delayed from a time at which a current detecting operation for detecting a current that passes through the primary transfer roller 5*d* of the black image forming section Pd is started. Then, similarly, for each of the image forming sections Pb and Pa, an application of the first test voltage Vft1 is started 0.6 sec. after a current detecting operation is started to be performed on an adjacent image forming section. An ATVC operation similar to that performed on the image forming section Pd is also performed on each of the image forming sections Pb and Pa. Additionally, in the first embodiment, a measurement of a current is started simultaneously with an application of a test voltage.

Because the time difference is provided in this manner, there is a positive effect, for example, that a region of the intermediate transfer belt 7 that has been charged in the yellow image forming section Pc does not reach a primary-transfer nip portion N1*d* of the image forming section Pd while a current detecting operation is being performed on the image forming section Pd.

The interval at which the image forming sections adjacent to one another are provided is denoted by L (mm). The current detection period from when a current measurement is started to when the current measurement is finished in an ATVC operation performed on each image forming section is denoted by T (sec.). The moving velocity of the intermediate transfer belt 7 is denoted by V (mm/sec.).

A period of time from when the current detection unit 53*d* starts a current detecting operation for detecting a current that passes through the primary transfer roller 5*d* to when the current detection unit 53*c* starts a current detecting operation for detecting a current that passes through the primary transfer roller 5*c* is denoted by t (sec.). When t (sec.) is set so as to satisfy the following relationship A, the above-described effect can be obtained.

$$t > T - L/V \qquad \text{Relationship A}$$

The "interval L at which the image forming sections adjacent to one another are provided" is a value obtained by measuring, along the path of the intermediate transfer belt 7, an interval between central positions of primary-transfer nip portions N1 adjacent to each other. In this embodiment, the interval L is 70 mm.

Figure 6:
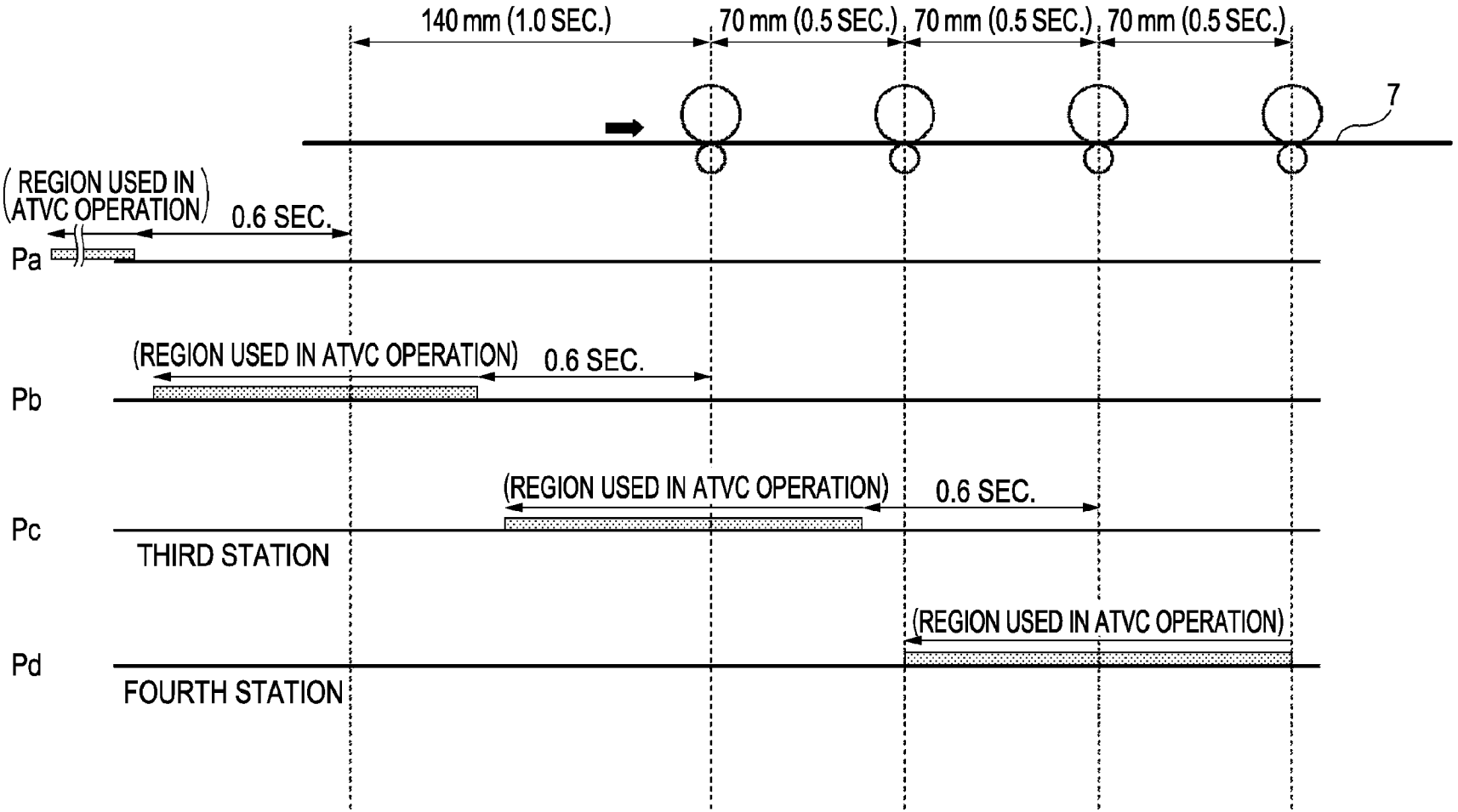
FIG. 6 illustrates regions of an intermediate transfer belt used in the ATVC operations according to the first embodiment.
Figure 7:
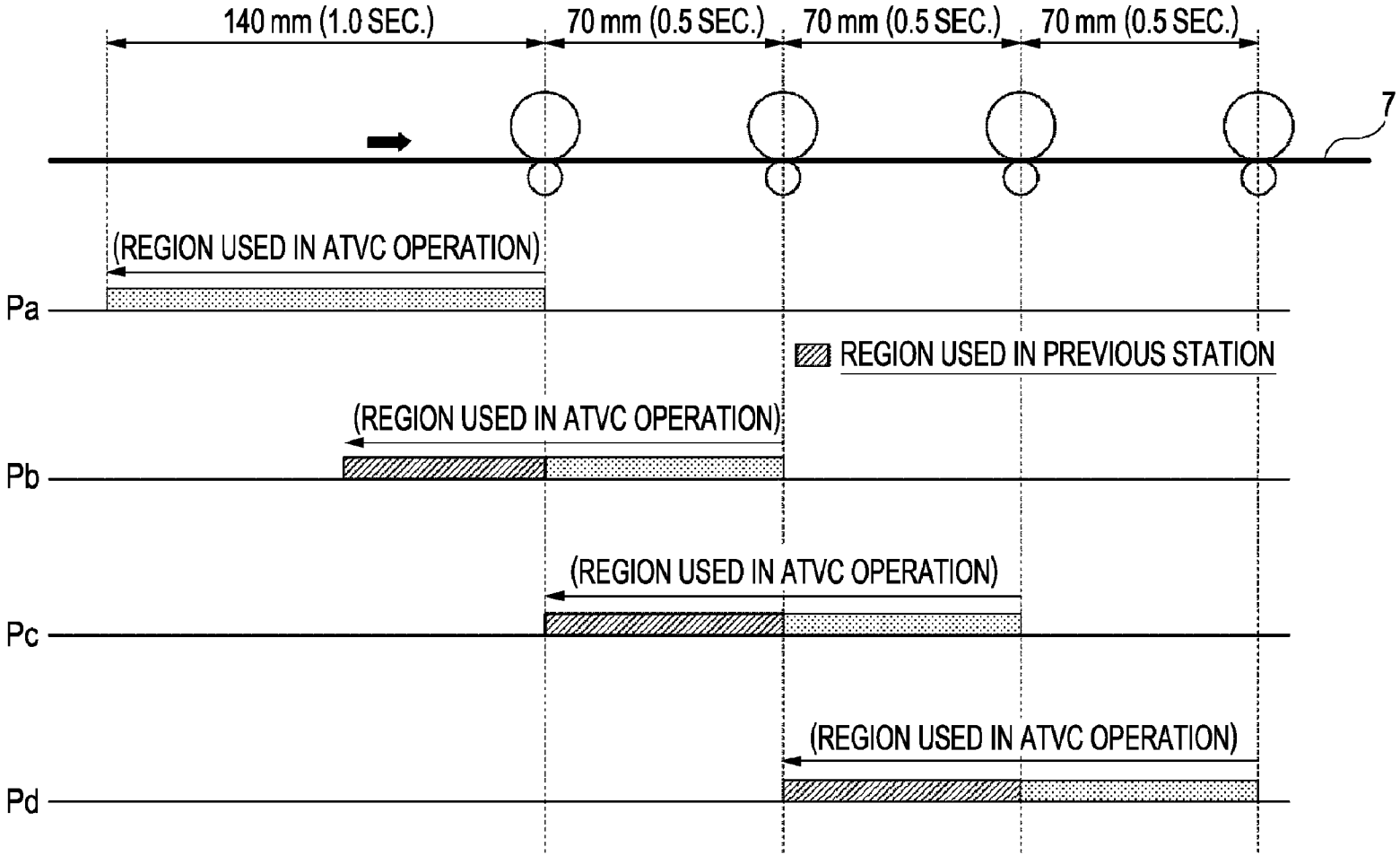
FIG. 7 illustrates regions of the intermediate transfer belt used in ATVC operations according to a comparative example.

FIG. 6 illustrates the relationship between a region of the intermediate transfer belt 7 used in an ATVC operation performed on an upstream image forming section and a region of the intermediate transfer belt 7 used in an ATVC operation performed on a downstream image forming section when ATVC operations are performed in accordance with the timing chart shown in FIG. 4. The distance denoted by a "region used in an ATVC operation" indicates a distance which the intermediate transfer belt 7 can be moved in the current detection period T. Furthermore, FIG. 7 illustrates a case in which ATVC operations are simultaneously started to be performed on all of the image forming sections as a comparative example.

When ATVC operations are started to be performed in such a manner that the time difference as shown in FIG. 6 is provided between the ATVC operations, there is no overlap between a region of the intermediate transfer belt 7 that has been used in an ATVC operation performed on an upstream image forming section (for example, the image forming section Pc) and a region of the intermediate transfer belt 7 that is to be used in an ATVC operation performed on a downstream image forming section (for example, the image forming section Pd). In contrast, referring to FIG. 7, the trailing end of a region of the intermediate transfer belt 7 that is to be used in an ATVC operation performed on a downstream image forming section is a portion of a region of the intermediate transfer belt 7 that has been used in an ATVC operation performed on an upstream image forming section. Accordingly, it is difficult to accurately detect a current.

As described above, a downstream image forming section does not use a region of the intermediate transfer belt 7 that has been used in an ATVC operation performed on an upstream image forming section. Thus, an appropriate primary transfer voltage can be set regardless of a charge state of the intermediate transfer belt 7.

Second Embodiment

An image forming apparatus according to a second embodiment of the present invention is the same as the image forming apparatus according to the first embodiment except as noted below. The interval L at which the image forming sections P adjacent to one another are provided in the image forming apparatus according to the second embodiment is longer than that in the image forming apparatus according to the first embodiment. Times at which ATVC operations are started to be performed on the image forming sections are different for the first and second embodiments. The details are described below. For the second embodiment, only configurations and control operations different from those according to the first embodiment are described. Also in the second embodiment, a measurement of a current is started simultaneously with an application of a test voltage.

Figure 8:
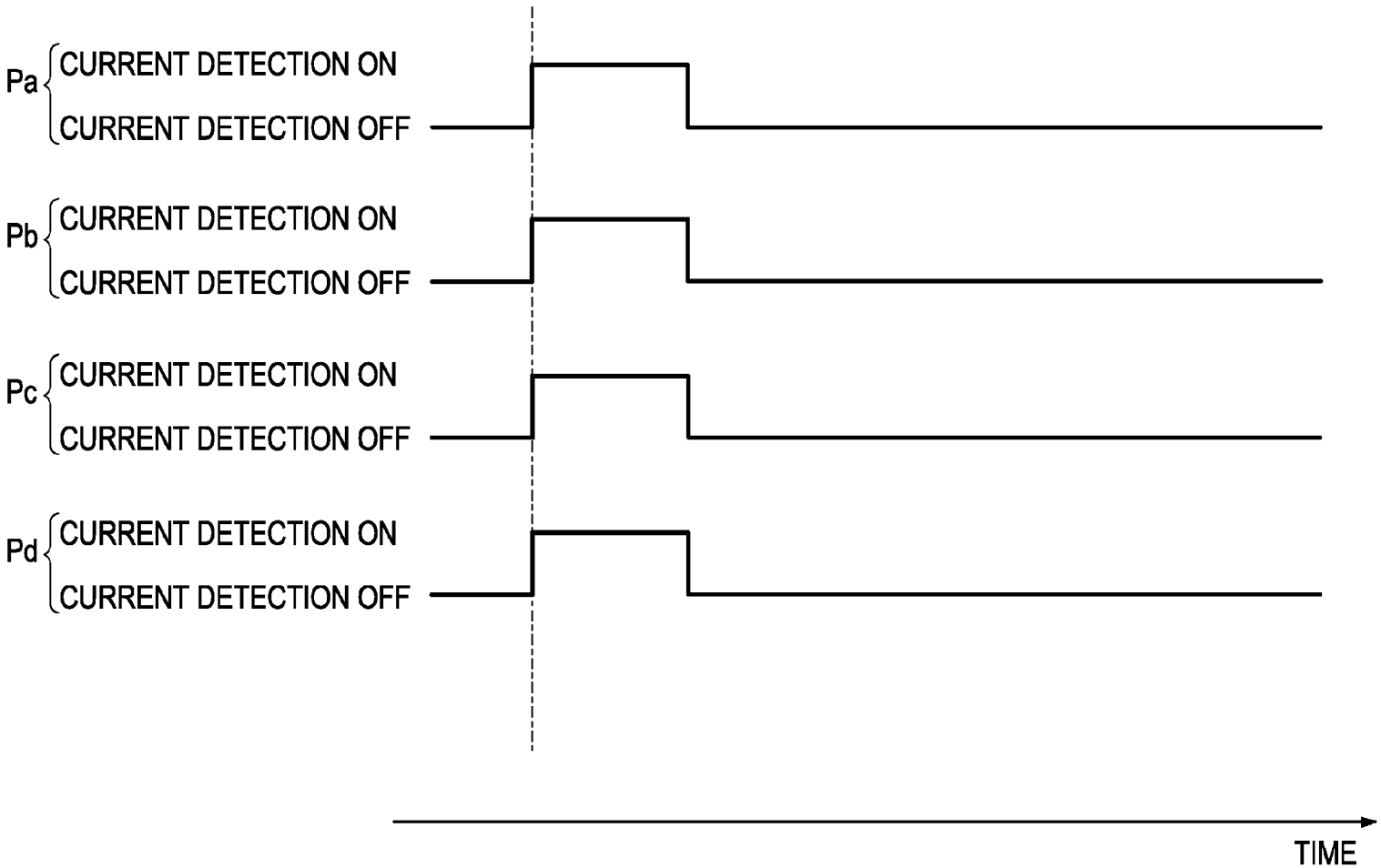
FIG. 8 is a timing chart of ATVC operations according to a second embodiment of the present invention.

FIG. 8 is a timing chart showing the sequence of ATVC operations according to the second embodiment. As shown FIG. 8, applications of the test voltages to all of the image forming sections Pa, Pb, Pc, and Pd are simultaneously started. In the second embodiment, because the interval L at which the image forming sections P adjacent to one another are provided is set to be longer, the applications of the test voltages to all of the image forming sections Pa, Pb, Pc, and Pd can be simultaneously started. Accordingly, a period of time taken to perform ATVC operations on the four image forming sections can be reduced.

In the second embodiment, the interval L (mm) at which the image forming sections P adjacent to one another are provided is set to be longer than a distance for which the intermediate transfer belt 7 can be moved in the current detection period T (sec.) when an ATVC operation is performed on each of the image forming sections. In the image forming apparatus according to the second embodiment, the following relationship is satisfied.

$$L>(V\times T) \qquad \text{Relationship B}$$

wherein V (mm/sec.) is the moving velocity of the intermediate transfer belt 7.

Figure 9:
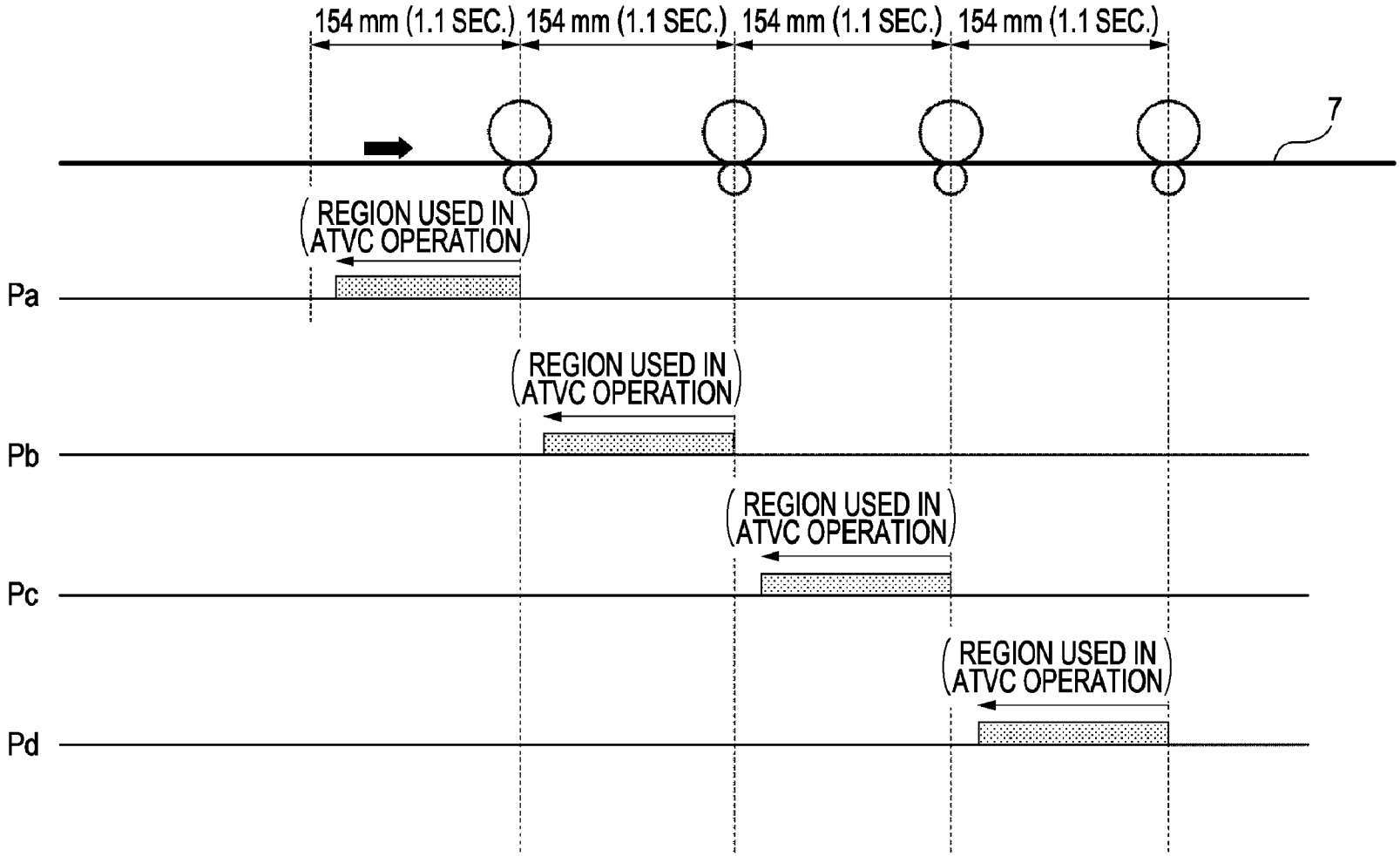
FIG. 9 illustrates regions of the intermediate transfer belt used in the ATVC operations according to the second embodiment.
Figure 10:
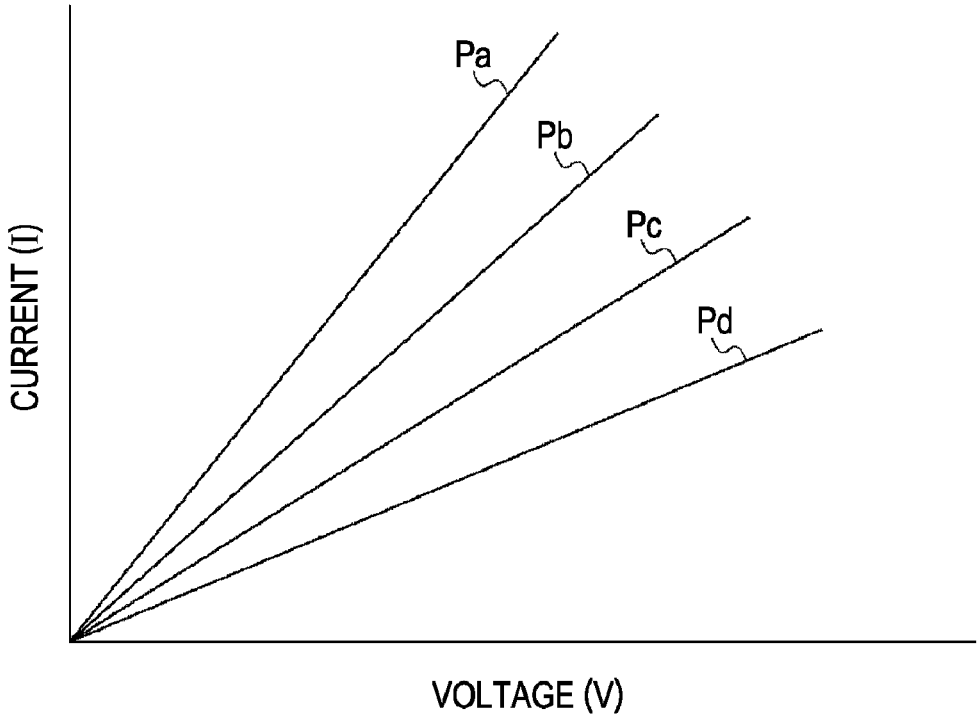
FIG. 10 is a representative graph of a voltage-versus-current relationship obtained in a case in which ATVC operations are simultaneously performed on all image forming sections of a conventional image forming apparatus.
Figure 11:
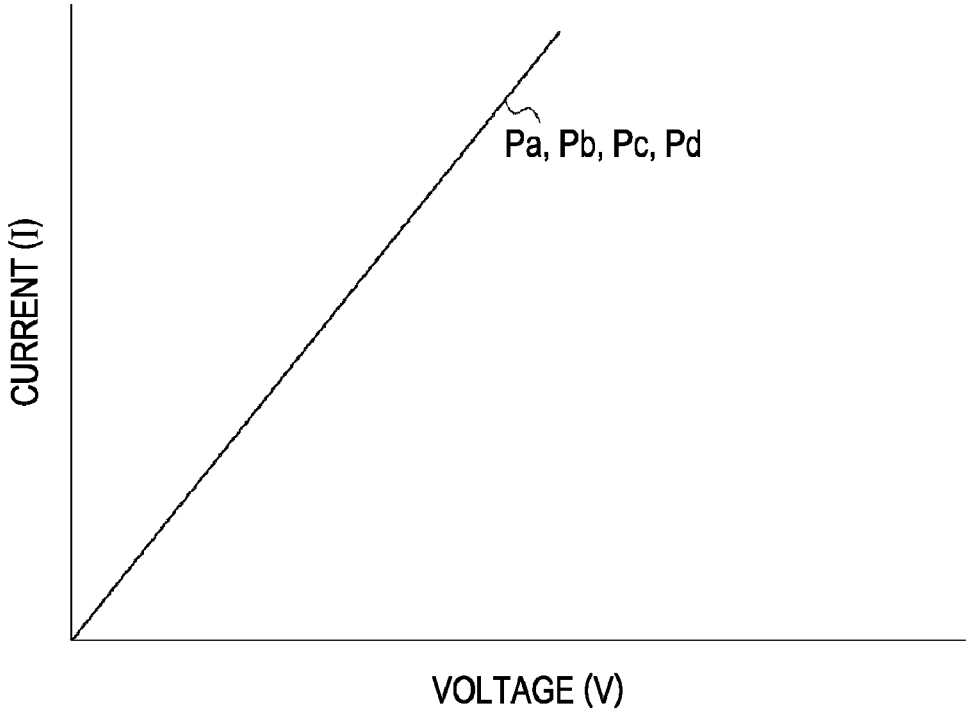
FIG. 11 is a representative graph of a voltage-versus-current relationship obtained in a case in which ATVC operations are performed at different times on the corresponding image forming sections of the conventional image forming apparatus.
Figure 12:
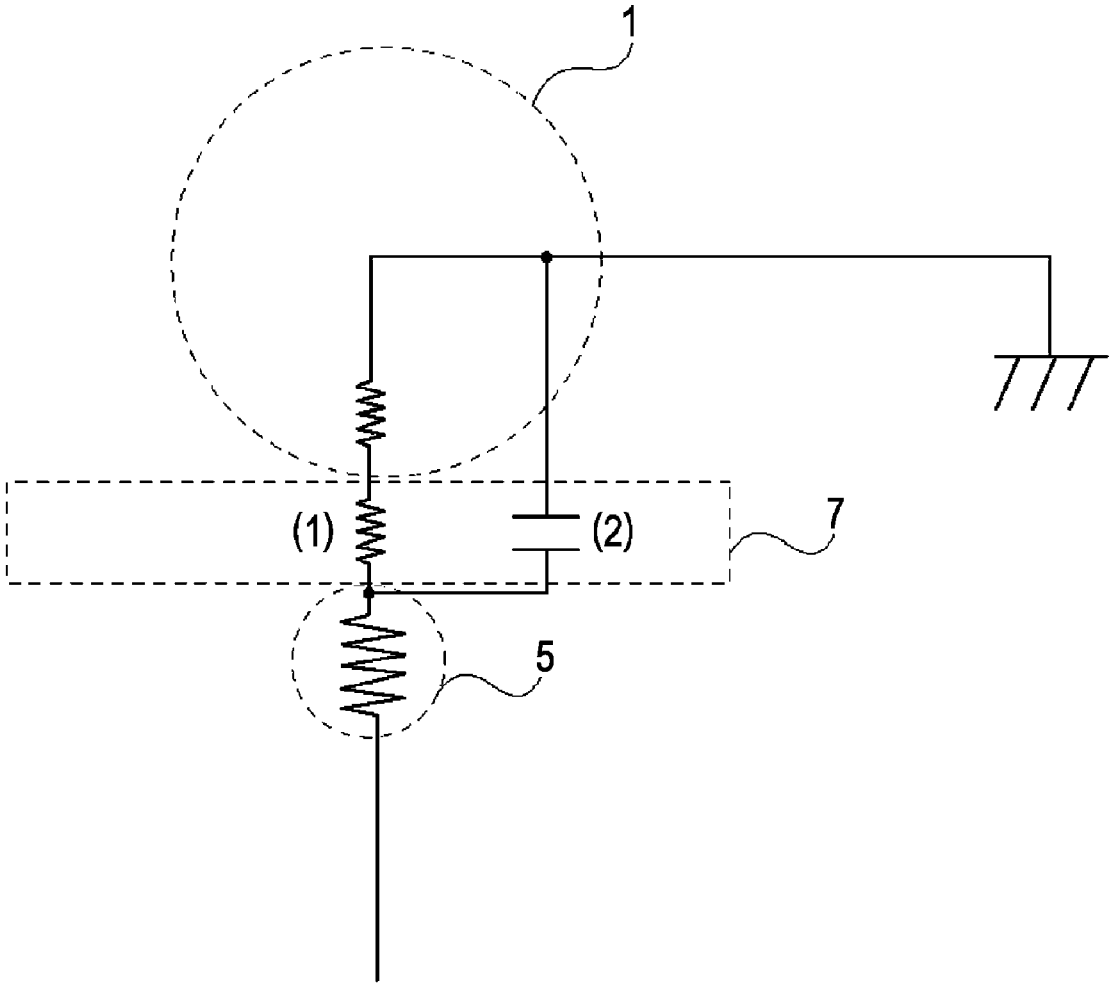
FIG. 12 is a diagram of an equivalent circuit of a primary transfer portion of the conventional image forming apparatus.

FIG. 9 illustrates the relationship between a region of the intermediate transfer belt 7 used in an ATVC operation performed on an upstream image forming section and a region of the intermediate transfer belt 7 used in an ATVC operation performed on a downstream image forming section. In the second embodiment, the interval L at which the image forming sections P adjacent to one another are provided is 154 mm. The moving velocity of the intermediate transfer belt 7 is 100 mm/sec. The current detection period T is 1.0 sec. In FIG. 9, the distance denoted by a "region used in an ATVC operation" indicates a distance for which the intermediate transfer belt 7 can be moved in the current detection period T (sec.) as in the case of FIG. 6.

When the interval L satisfies the relationship B, there is no overlap between a region of the intermediate transfer belt 7 that has been used in an ATVC operation performed on an upstream image forming section (for example, the image forming section Pc) and a region of the intermediate transfer belt 7 that is to be used in an ATVC operation performed on a downstream image forming section (for example, the image forming section Pd).

In this manner, an appropriate primary transfer voltage can be set regardless of a charge state of the intermediate transfer belt 7. Thus, a period of time taken to perform ATVC operations can be reduced.

In the first and second embodiments, currents are detected, which pass through the primary transfer roller 5 when the test voltages are applied. However, instead of the method, the primary transfer voltage can be set in accordance with voltages that are generated across the primary transfer roller 5 when test currents are applied to flow.

According to any of the embodiments of the present invention, even when the intermediate transfer member is charged by applying test voltages or test currents, a negative influence of charge on the intermediate transfer member that has on a detecting operation which is performed on a downstream image forming section can be reduced.

Figure 13:
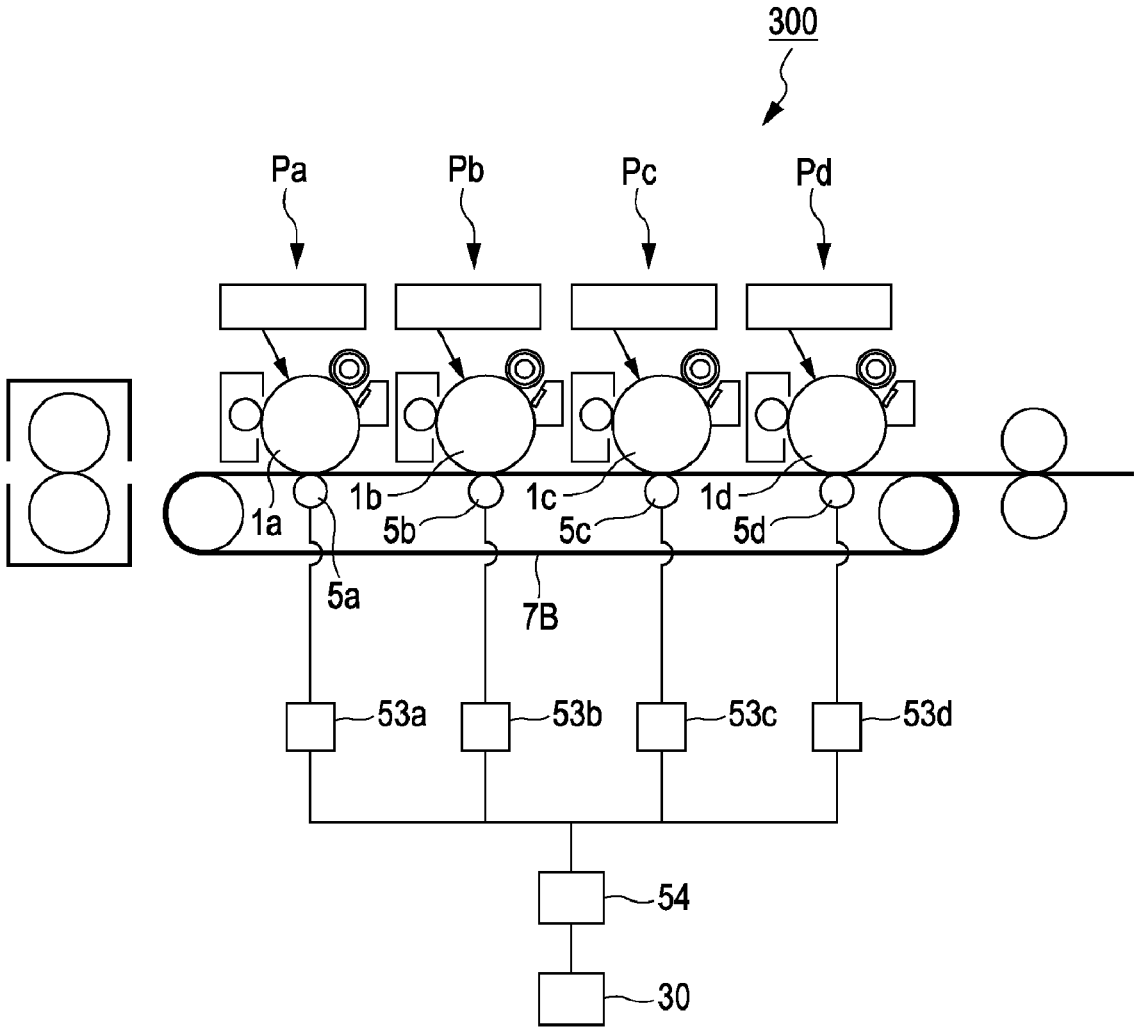
FIG. 13 is a diagram of an image forming apparatus using a recording-medium conveying belt according to another embodiment of the present invention.

In another embodiment of the present invention, as shown in FIG. 13, an image forming apparatus 300 is provided. This embodiment differs from the preceding embodiments in that the toner images are transferred from the photoconductor drums (image bearing members) directly onto a recording medium carried by an endless belt, instead of undergoing a primary transfer from the drum onto an intermediate transfer member and then a secondary transfer from the intermediate transfer member onto the recording medium.

The image forming apparatus 300 is a full-color image forming apparatus in which yellow, magenta, cyan, and black image forming sections Pa, Pb, Pc, and Pd are disposed on a horizontal portion of a recording medium conveying belt 7B serving as a belt member. The image forming sections Pa, Pb, Pc, and Pd have substantially the same configuration, except that the colors of toners filling development devices which are provided in the vicinity of the corresponding image forming sections Pa, Pb, Pc, and Pd are different from one another, for example, yellow, magenta, cyan, and black.

Primary transfer rollers 5*a*, 5*b*, 5*c*, 5*d* press and are in contact with photoconductor drums 1*a*, 1*b*, 1*c*, and 1*d*, respectively, via the recording medium conveying belt 7B to form corresponding transfer portions. Toner images that are formed on the photoconductor drums 1*a*, 1*b*, 1*c*, and 1*d* are transferred onto the surface of a recording medium P carried by the recording medium conveying belt 7B in such a manner that the toner images are sequentially superimposed onto top of one another. The configuration according to any of the embodiments of the present invention is applied also to an image forming apparatus such as the image forming apparatus 300, whereby a similar positive effect can be obtained.

Various embodiments of the present invention are described above. However, the present invention is not limited to the above-described embodiments. Various modifications can be made without departing from the technical scope of the present invention.

While the present invention is described above with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2007-243959 filed Sep. 20, 2007, which is hereby incorporated by reference herein in its entirety.

What is claimed is:

1. An image forming apparatus comprising:

a belt member;

a first image bearing member;

a first transfer member arranged to form a first transfer portion that transfers a toner image formed on the first image bearing member onto the belt member;

a second image bearing member that is disposed at a certain position so that the first and second image bearing members are adjacent to each other;

a second transfer member arranged to form a second transfer portion that transfers a toner image formed on the second image bearing member onto the belt member;

an execution unit arranged to execute a first step of determining a value of a first transferring voltage to be applied to the first transfer member, the first transferring voltage being used to transfer the toner image onto the belt member by applying a voltage to the first transfer member, and a second step of determining a value of a second transferring voltage to be applied to the second transfer member, the second transferring voltage being used to transfer the toner image onto the belt member by applying the voltage to the second transfer member; and a control unit arranged to control execution timing of the first and second steps so that a region of the belt member corresponding to the first transfer member to which the voltage is applied in the first step does not overlap a region of the belt member corresponding to the second transfer member to which the voltage is applied in the second step.

2. The image forming apparatus according to claim 1, wherein, in a case in which a period of time taken by the second step is denoted by T (sec.), a period of time from when the second step starts to when the first step starts is denoted by t (sec.), an interval between the first transfer portion and the second transfer portion is denoted by L (mm), and a moving velocity of the belt member is denoted by V (mm/sec.), a relationship that $t>T-L/V$ is obtained.

3. The image forming apparatus according to claim 1, wherein, in a case in which a period of time taken by the second step is denoted by T (sec.), an interval between the first transfer portion and the second transfer portion is denoted by L (mm), and a moving velocity of the belt member is denoted by V (mm/sec.), a relationship that $L>(V\times T)$ is obtained.

4. The image forming apparatus according to claim 1, wherein a surface resistivity of a surface of the belt member is in the range from $1\times10^{11}$ Ω/sq. to $9\times10^{13}$ Ω/sq.

5. An image forming apparatus comprising:

a belt member that conveys a recording medium;

a first image bearing member;

a first transfer member arranged to form a first transfer portion that transfers a toner image formed on the first image bearing member onto the recording medium on the belt member;

a second image bearing member that is disposed at a certain position so that the first and second image bearing members are adjacent to each other;

a second transfer member arranged to form a second transfer portion that transfers a toner image formed on the second image bearing member onto the recording medium on the belt member;

an execution unit arranged to execute a first step of determining a value of a first transferring voltage to be applied to the first transfer member, the first transferring voltage being used to transfer the toner image onto the recording medium on the belt member by applying a voltage to the first transfer member, and a second step of determining a value of a second transferring voltage to be applied to the second transfer member, the second transferring voltage being used to transfer the toner image onto the recording medium on the belt member by applying a voltage to the second transfer member; and a control unit arranged to control execution timing of the first and second steps so that a region of the belt member corresponding to the first transfer member to which the voltage is applied in the first step does not overlap a region of the belt member corresponding to the second transfer member to which the voltage is applied in the second step.

6. The image forming apparatus according to claim 5, wherein, in a case in which a period of time taken by the second step is denoted by T (sec.), a period of time from when the second step starts to when the first step starts is denoted by t (sec.), an interval between the first transfer portion and the second transfer portion is denoted by L (mm), and a moving velocity of the belt member is denoted by V (mm/sec.), a relationship that $t>T-L/V$ is obtained.

7. The image forming apparatus according to claim 5, wherein, in a case in which a period of time taken by the second step is denoted by T (sec.), an interval between the first transfer portion and the second transfer portion is denoted by L (mm), and a moving velocity of the belt member is denoted by V (mm/sec.), a relationship that $L>(V\times T)$ is obtained.

8. The image forming apparatus according to claim 5, wherein a surface resistivity of a surface of the belt member is in the range from $1\times10^{11}$ Ω/sq. to $9\times10^{13}$ Ω/sq.

9. Image forming apparatus comprising:

a belt member supported for rotational movement through first and second positions, the second position being downstream of the first position in the direction of movement;

a first transfer unit which transfers a toner image onto the belt member, or onto a recording medium carried by the belt member, at said first position;

a second transfer unit which transfers a toner image onto the belt member or the recording medium, as the case may be, at said second position; and a testing unit which causes each of the first and second transfer units to carry out a test operation in which the transfer unit concerned applies one or more test energizations to the belt member during such movement thereof;

wherein the apparatus is arranged and controlled such that the test operation carried out by the second transfer unit is completed before any part of a region of the moving belt member that is charged as a result of the test operation carried out by the first transfer unit reaches the second position.

10. Image forming apparatus according to claim 9, arranged and controlled such that the test operation carried out by the first transfer unit is started a predetermined time interval t after the test operation carried out by the second transfer unit is started, where $t>T-L/V$, T is a duration of the test operation carried out by the second transfer unit, L is a spacing between said first and second positions, and V is a velocity of said rotational movement of the belt member.

11. Image forming apparatus according to claim 9, arranged and controlled such that the test operation carried out by the first transfer unit is started before completion of the test operation carried out by the second transfer unit.

12. Image forming apparatus according to claim 9, arranged and controlled such that a spacing L between said first and second positions is greater than $V\times T$, where V is a velocity of said rotational movement of the belt member, and T is a duration of the test operation carried out by the second transfer unit.

13. Image forming apparatus according to claim 9, arranged and controlled such that the first and second transfer units carry out their respective test operations substantially simultaneously.

14. Image forming apparatus according to claim 9, wherein each of said first and second transfer units comprises a rotary member and said testing unit causes said rotary member to undergo at least one revolution during the or each said test energization.

15. Image forming apparatus according to claim 9, wherein said testing unit causes one or both of said first and second transfer units to carry out two or more such test energizations using different test voltages or currents.

16. Image forming apparatus according to claim 9, wherein said testing unit is operable, for one or both of said first and second transfer units, to take one or more measurements during said one or more test energizations, and to employ said one or more measurements to set a working voltage used by the transfer unit concerned to bring about the transfer of said toner image onto the belt member or the recording medium, as the case may be.

17. The image forming apparatus according to claim 9, wherein a surface resistivity of a surface of the belt member is in the range from $1\times10^{11}$ Ω/sq. to $9\times10^{13}$ Ω/sq.

* * * * *